US011432391B1

(12) United States Patent
Peng

(10) Patent No.: US 11,432,391 B1
(45) Date of Patent: Aug. 30, 2022

(54) LIGHT EMITTING DIODE SYSTEM RECEIVING WIRELESS SIGNAL

(71) Applicant: Semisilicon Technology Corp., New Taipei (TW)

(72) Inventor: Wen-Chi Peng, New Taipei (TW)

(73) Assignee: SEMISILICON TECHNOLOGY CORP., New Taipei (TW)

( * ) Notice: Subject to any disclaimer, the term of this patent is extended or adjusted under 35 U.S.C. 154(b) by 0 days.

(21) Appl. No.: 17/404,334

(22) Filed: Aug. 17, 2021

(51) Int. Cl.
*H05B 47/19* (2020.01)
*H05B 45/14* (2020.01)
*H05B 45/30* (2020.01)

(52) U.S. Cl.
CPC ..... *H05B 47/19* (2020.01); *H05B 45/14* (2020.01); *H05B 45/30* (2020.01)

(58) Field of Classification Search
CPC ..... H05B 47/19; H05B 45/14; H05B 45/30
See application file for complete search history.

(56) References Cited

U.S. PATENT DOCUMENTS 5,627,489 A * 5/1997 Jochum ..... H03K 19/00384 326/62
2017/0290120 A1* 10/2017 Peng ..... H05B 47/175

* cited by examiner

*Primary Examiner* — Daniel D Chang
(74) *Attorney, Agent, or Firm* — Muncy, Geissler, Olds & Lowe, P.C.

(57) ABSTRACT

A light emitting diode system includes at least one light emitting diode and a light emitting diode driving apparatus. The light emitting diode driving apparatus includes a burning signal detector, a burning controller, a memory and a light emitting diode circuit. The burning signal detector includes an optical element, a signal trimmer and a signal detector. The burning signal detector wirelessly receives a wireless signal. The burning signal detector converts the wireless signal into a local stored signal. The burning signal detector transmits the local stored signal to the burning controller. The burning controller burns the local stored signal into the memory, so that the memory stores a local data.

10 Claims, 5 Drawing Sheets

LIGHT EMITTING DIODE SYSTEM RECEIVING WIRELESS SIGNAL

BACKGROUND

Technical Field

The present disclosure relates to a light emitting diode system, and especially relates to a light emitting diode system receiving a wireless signal.

Description of Related Art

Currently, there are two types of the related art light emitting diode systems: the serial-type light emitting diode system and the parallel-type light emitting diode system. Both the serial-type light emitting diode system and the parallel-type light emitting diode system need to use a plurality of power transmission lines and signal transmission lines, which waste wires. Afterwards, the related art technology which transmits the lighting signal through the power transmission line is provided to save the signal transmission lines, wherein the lighting signal includes a lighting data and a data.

The local data has to be burned into the light emitting diode driving apparatus when the light emitting diode driving apparatus of the light emitting diode system is manufactured. The light emitting diode driving apparatus checks whether the data of the lighting signal is the same with the local data of the light emitting diode driving apparatus when the light emitting diode driving apparatus receives the lighting signal mentioned above. The light emitting diode driving apparatus drives the light emitting diodes of the light emitting diode system to light based on the lighting data of the lighting signal if the data of the lighting signal is the same with the local data of the light emitting diode driving apparatus.

However, the disadvantage of the method mentioned above is that once the light emitting diode driving apparatus had been manufactured, the local data cannot be changed. Therefore, it is very inconvenient for the warehouse management. Moreover, it is also very inconvenient for assembling a lot of the light emitting diode driving apparatuses because the operator has to check the local data of every light emitting diode driving apparatus carefully to avoid assembling any incorrect light emitting diode driving apparatus.

SUMMARY

In order to solve the above-mentioned problems, an object of the present disclosure is to provide a light emitting diode system.

In order to achieve the object of the present disclosure mentioned above, the light emitting diode system of the present disclosure includes at least one light emitting diode and a light emitting diode driving apparatus. The light emitting diode driving apparatus is electrically connected to the at least one light emitting diode. Moreover, the light emitting diode driving apparatus includes a burning signal detector, a burning controller, a memory and a light emitting diode circuit. The burning controller is electrically connected to the burning signal detector. The memory is electrically connected to the burning controller. The light emitting diode circuit is electrically connected to the at least one light emitting diode and the memory. Moreover, the burning signal detector includes an optical element, a signal trimmer and a signal detector. The signal trimmer is electrically connected to the optical element. The signal detector is electrically connected to the signal trimmer and the burning controller. Moreover, the burning signal detector is configured to wirelessly receive a wireless signal. After the burning signal detector receives the wireless signal, the burning signal detector is configured to convert the wireless signal into a local stored signal. After the burning signal detector converts the wireless signal into the local stored signal, the burning signal detector is configured to transmit the local stored signal to the burning controller. The burning controller is configured to receive the local stored signal. After the burning controller receives the local stored signal, the burning controller is configured to burn the local stored signal into the memory, so that the memory is configured to store a local data.

Moreover, in an embodiment of the light emitting diode system of the present disclosure mentioned above, moreover the signal trimmer is, for example but not limited to, a filter or a signal shaper.

Moreover, in an embodiment of the light emitting diode system of the present disclosure mentioned above, moreover the burning signal detector further includes an impedance load. The impedance load is electrically connected to the optical element and the signal trimmer.

Moreover, in an embodiment of the light emitting diode system of the present disclosure mentioned above, moreover the impedance load is, for example but not limited to, a metal oxide semiconductor field effect transistor.

Moreover, in an embodiment of the light emitting diode system of the present disclosure mentioned above, moreover the burning signal detector further includes a voltage source. The voltage source is electrically connected to the optical element and the impedance load.

Moreover, in an embodiment of the light emitting diode system of the present disclosure mentioned above, moreover the optical element is, for example but not limited to, a PN junction, a photo transistor or a photo diode.

Moreover, in an embodiment of the light emitting diode system of the present disclosure mentioned above, the light emitting diode system further includes a burner. The burner is wirelessly connected to the burning signal detector. Moreover, the burner is configured to wirelessly transmit the wireless signal to the optical element of the burning signal detector.

Moreover, in an embodiment of the light emitting diode system of the present disclosure mentioned above, the light emitting diode system further includes a positive contact. Moreover, the light emitting diode circuit includes a light emitting diode driving circuit, a signal conversion unit, a data identifier, a logic controller, a shift register, an output register, a register and a comparator. The light emitting diode driving circuit is electrically connected to the at least one light emitting diode. The signal conversion unit is electrically connected to the positive contact. The data identifier is electrically connected to the signal conversion unit. The logic controller is electrically connected to the data identifier and the memory. The shift register is electrically connected to the logic controller. The output register is electrically connected to the shift register and the light emitting diode driving circuit. The register is electrically connected to the data identifier and the logic controller. The comparator is electrically connected to the logic controller, the register and the memory.

Moreover, in an embodiment of the light emitting diode system of the present disclosure mentioned above, the light emitting diode system further includes a negative contact.

Moreover, the light emitting diode circuit further includes a voltage regulator and an oscillator. The voltage regulator is electrically connected to the positive contact, the negative contact and the signal conversion unit. The oscillator is electrically connected to the positive contact, the voltage regulator, the signal conversion unit, the data identifier, the logic controller, the shift register and the output register.

Moreover, in an embodiment of the light emitting diode system of the present disclosure mentioned above, moreover the signal conversion unit includes a constant voltage generator, a voltage subtractor (or a signal amplifier) and a signal filter. The constant voltage generator is electrically connected to the positive contact. The voltage subtractor (or the signal amplifier) is electrically connected to the constant voltage generator. The signal filter is electrically connected to the voltage subtractor (or the signal amplifier) and the data identifier.

The advantage of the present disclosure is to burn the local stored signal into the light emitting diode driving apparatus which had been manufactured to store or change the local data, and the light emitting diode driving apparatus can be burned repeatedly.

Please refer to the detailed descriptions and figures of the present disclosure mentioned below for further understanding the technology, method and effect of the present disclosure achieving the predetermined purposes. It believes that the purposes, characteristic and features of the present disclosure can be understood deeply and specifically. However, the figures are only for references and descriptions, but the present disclosure is not limited by the figures.

DETAILED DESCRIPTION

Figure 1:
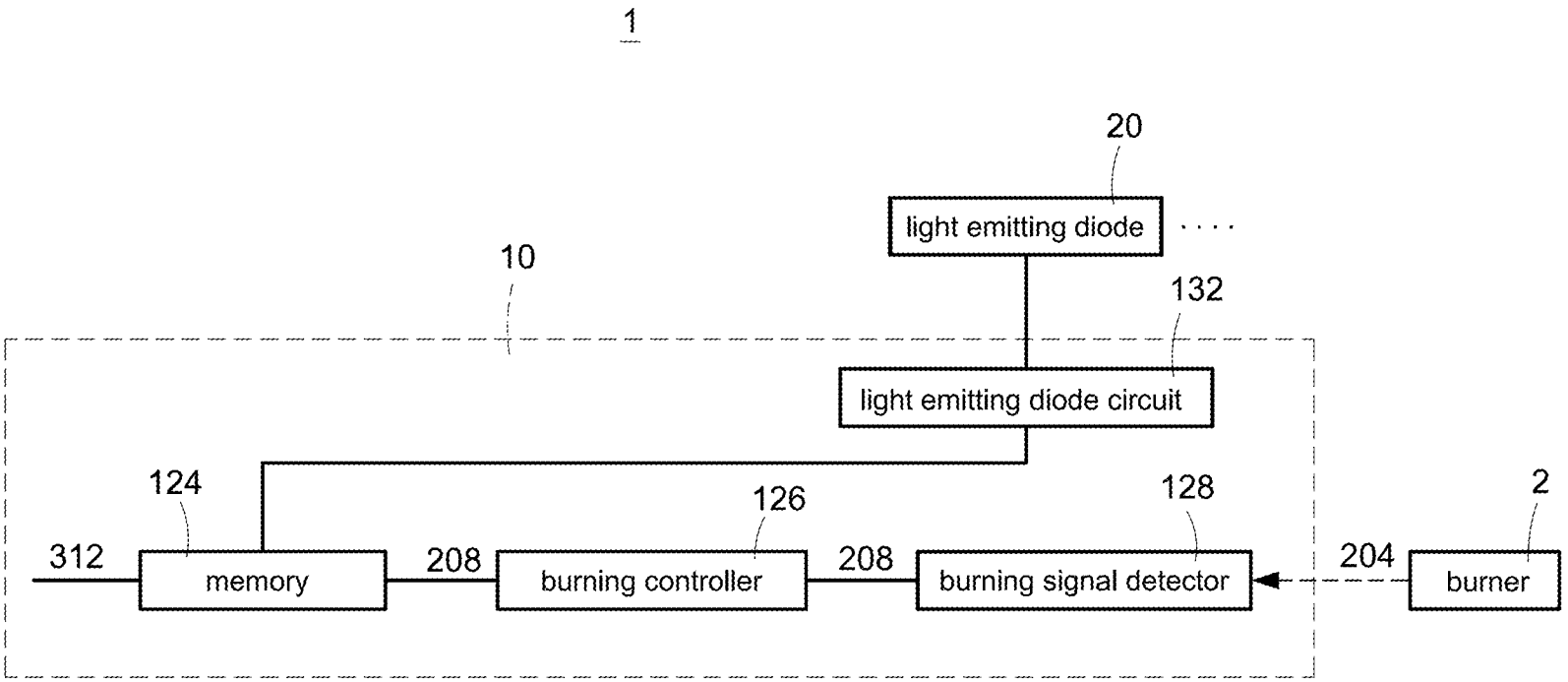
FIG. 1 shows a block diagram of an embodiment of the light emitting diode system of the present disclosure.

In the present disclosure, numerous specific details are provided, to provide a thorough understanding of embodiments of the disclosure. Persons of ordinary skill in the art will recognize, however, that the present disclosure can be practiced without one or more of the specific details. In other instances, well-known details are not shown or described to avoid obscuring aspects of the present disclosure. Now please refer to the figures for the explanation of the technical content and the detailed description of the present disclosure:

FIG. 1 shows a block diagram of an embodiment of the light emitting diode system of the present disclosure. A light emitting diode system 1 of the present disclosure includes at least one light emitting diode 20, a light emitting diode driving apparatus 10 and a burner 2. The light emitting diode driving apparatus 10 includes a burning signal detector 128, a burning controller 126, a memory 124 and a light emitting diode circuit 132. The components mentioned above are electrically or wirelessly connected to each other. The memory 124 is, for example but not limited to, a one-time programmable memory or a multiple-time programmable memory, such as an e-fuse memory, an erasable programmable read only memory (EPROM), an electrically erasable programmable read only memory (EEPROM) or a flash memory.

The burner 2 is configured to wirelessly transmit a wireless signal 204 to the burning signal detector 128. The burning signal detector 128 is configured to wirelessly receive the wireless signal 204. After the burning signal detector 128 receives the wireless signal 204, the burning signal detector 128 is configured to convert the wireless signal 204 into a local stored signal 208 (which is also known as a local address signal). After the burning signal detector 128 converts the wireless signal 204 into the local stored signal 208, the burning signal detector 128 is configured to transmit the local stored signal 208 to the burning controller 126. The burning controller 126 is configured to receive the local stored signal 208. After the burning controller 126 receives the local stored signal 208, the burning controller 126 is configured to burn the local stored signal 208 into the memory 124, so that the memory 124 is configured to store a local data 312.

Figure 2:
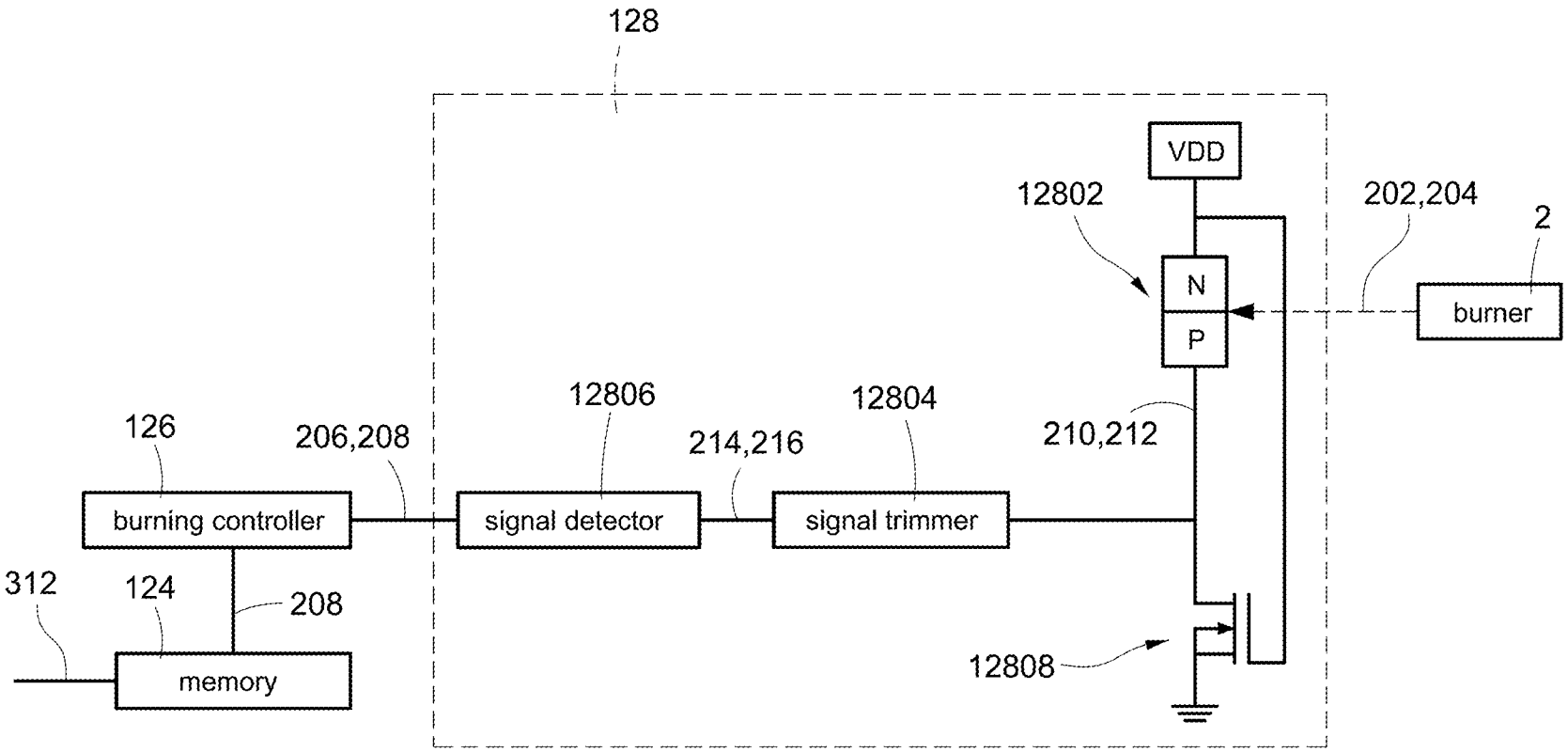
FIG. 2 shows a block diagram of an embodiment of the burning signal detector of the present disclosure.
Figure 3:
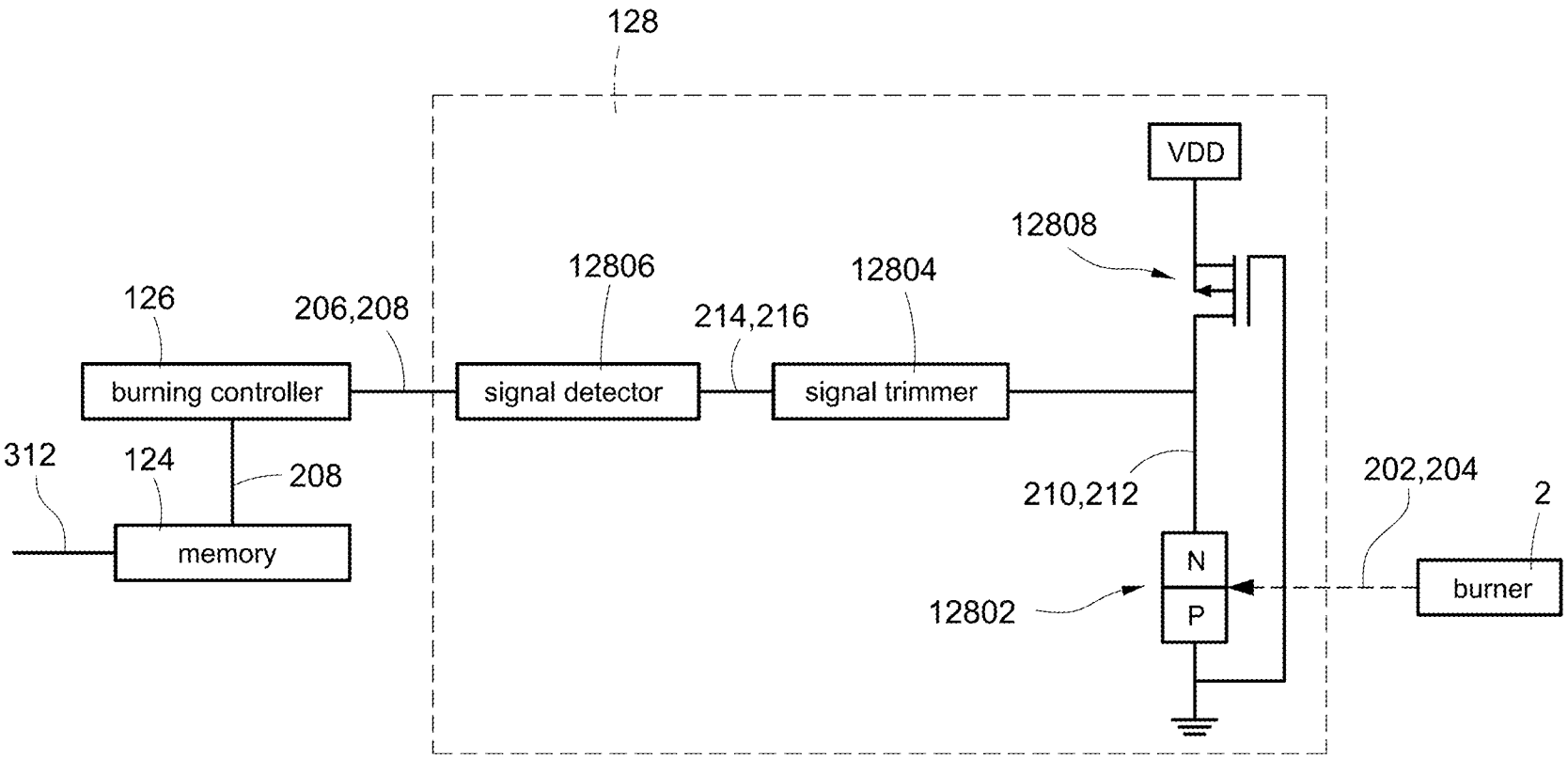
FIG. 3 shows a block diagram of another embodiment of the burning signal detector of the present disclosure.

FIG. 2 shows a block diagram of an embodiment of the burning signal detector of the present disclosure. FIG. 3 shows a block diagram of another embodiment of the burning signal detector of the present disclosure. Please refer to FIG. 1 to FIG. 3 at the same time. The burning signal detector 128 includes an optical element 12802, a signal trimmer 12804, a signal detector 12806, an impedance load 12808 and a voltage source VDD. The components mentioned above are electrically connected to each other. The optical element 12802 is, for example but not limited to, a PN junction (or a PN interface) of an integrated circuit, a photo transistor or a photo diode, wherein the PN junction (or the PN interface) generates a leakage electricity phenomenon to be used as a signal source when the PN junction (or the PN interface) is subjected to a light. The signal trimmer 12804 is, for example but not limited to, a filter or a signal shaper. The impedance load 12808 is, for example but not limited to, a metal oxide semiconductor field effect transistor.

Moreover, the optical element 12802 is configured to wirelessly receive a wireless starting signal 202 and the wireless signal 204. After the optical element 12802 wirelessly receives the wireless starting signal 202, the optical element 12802 is configured to sense and convert the wireless starting signal 202 into a first sensing signal 210. After the optical element 12802 wirelessly receives the wireless signal 204, the optical element 12802 is configured to sense and convert the wireless signal 204 into a second sensing signal 212. After the optical element 12802 senses and converts the wireless starting signal 202 into the first sensing signal 210, the optical element 12802 is configured to transmit the first sensing signal 210 to the signal trimmer 12804. After the optical element 12802 senses and converts the wireless signal 204 into the second sensing signal 212, the optical element 12802 is configured to transmit the second sensing signal 212 to the signal trimmer 12804. The signal trimmer 12804 is configured to receive the first sensing signal 210 and the second sensing signal 212. After the signal trimmer 12804 receives the first sensing signal 210, the signal trimmer 12804 is configured to filter or shape the first sensing signal 210 to obtain a first trimmed signal 214. After the signal trimmer 12804 receives the second sensing signal 212, the signal trimmer 12804 is configured to filter or shape the second sensing signal 212 to obtain a second trimmed signal 216. After the signal trimmer 12804 obtains the first trimmed signal 214 and the second trimmed signal 216, the signal trimmer 12804 is configured to transmit the first trimmed signal 214 and the second trimmed signal 216 to the signal detector 12806.

Moreover, the burner 2 is configured to wirelessly transmit the wireless starting signal 202 and the wireless signal 204 to the optical element 12802. The burner 2 is a laser burner. The wireless starting signal 202 is a laser signal. The wireless signal 204 is a laser signal. Because the energy of the laser is strong enough, the burning signal detector 128 only needs the signal trimmer 12804 but does not need any amplifier.

Moreover, the signal detector 12806 is configured to receive the first trimmed signal 214 and the second trimmed signal 216. After the signal detector 12806 receives the first trimmed signal 214, the signal detector 12806 is configured to detect the first trimmed signal 214 to obtain a wired starting signal 206. After the signal detector 12806 receives the second trimmed signal 216, the signal detector 12806 is configured to detect the second trimmed signal 216 to obtain the local stored signal 208. After the signal detector 12806 obtains the wired starting signal 206 and the local stored signal 208, the signal detector 12806 is configured to transmit the wired starting signal 206 and the local stored signal 208 to the burning controller 126. The burning controller 126 is configured to receive the wired starting signal 206 and the local stored signal 208. After the burning controller 126 receives the wired starting signal 206 and the local stored signal 208, the burning controller 126 is configured to burn the local stored signal 208 into the memory 124, so that the memory 124 is configured to store the local data 312.

Figure 4:
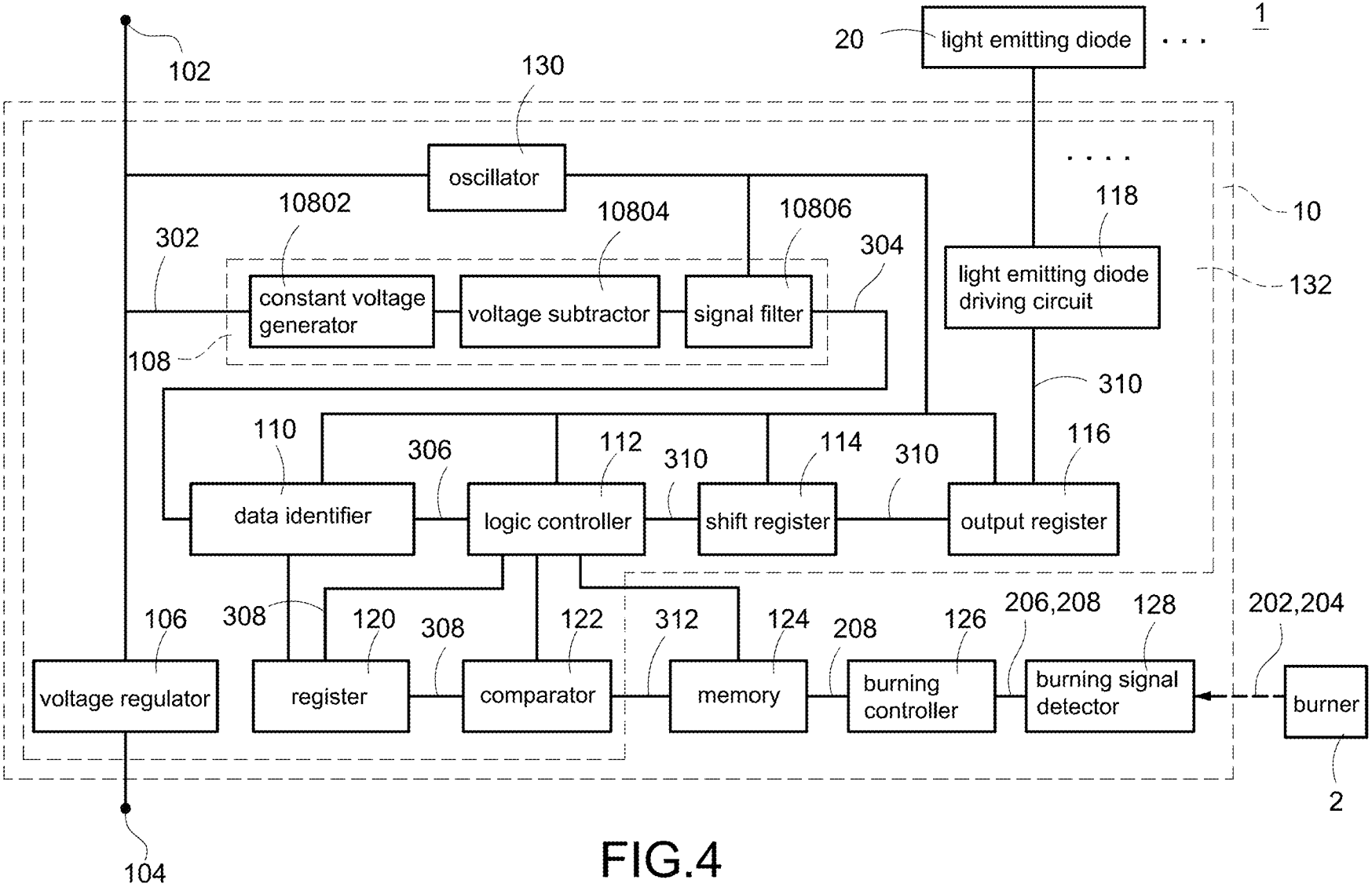
FIG. 4 shows a block diagram of another embodiment of the light emitting diode system of the present disclosure.
Figure 5:
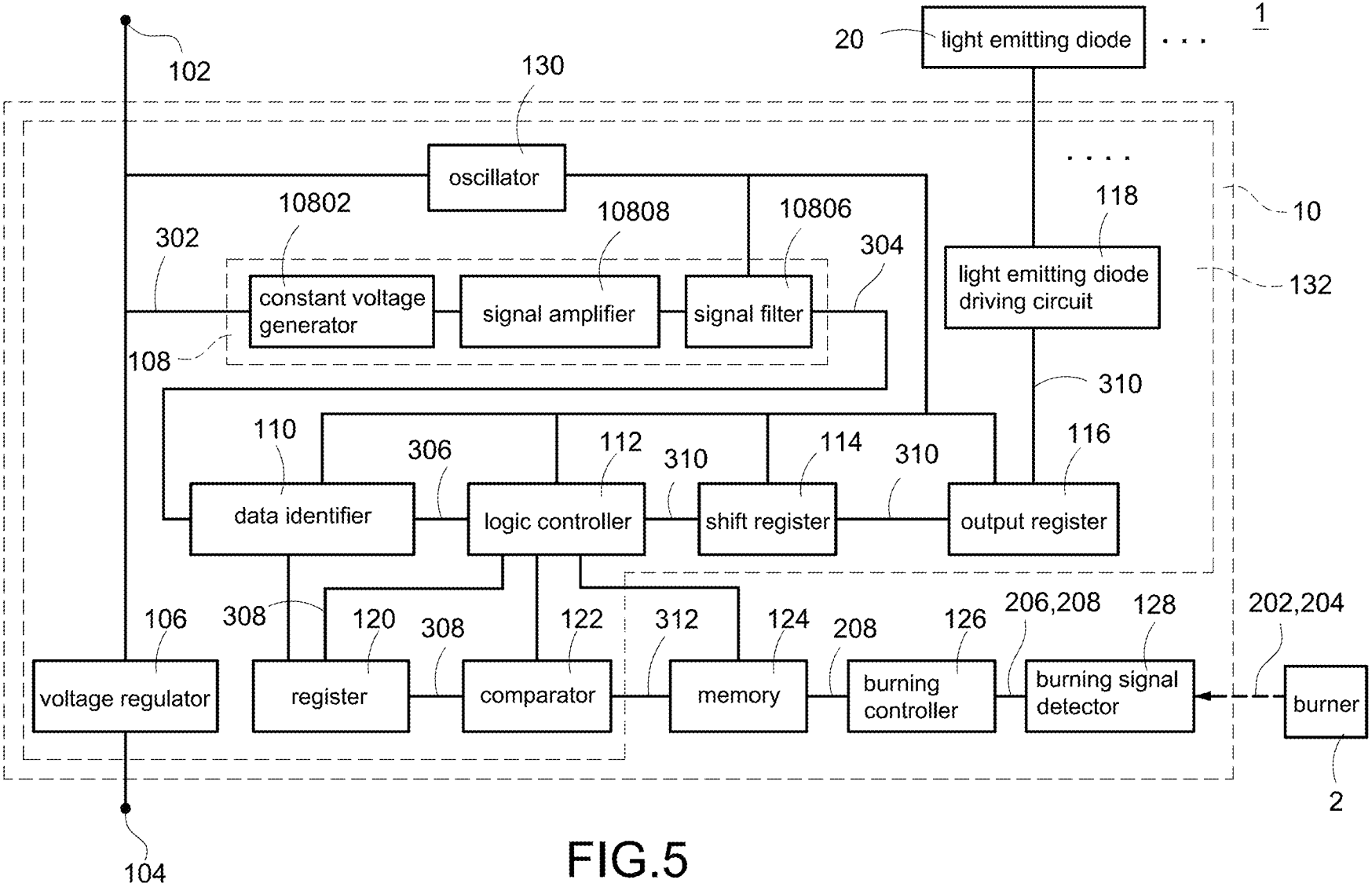
FIG. 5 shows a block diagram of still another embodiment of the light emitting diode system of the present disclosure.

FIG. 4 shows a block diagram of another embodiment of the light emitting diode system of the present disclosure. FIG. 5 shows a block diagram of still another embodiment of the light emitting diode system of the present disclosure. Please refer to FIG. 1 to FIG. 5 at the same time. The light emitting diode system 1 further includes a positive contact 102 and a negative contact 104. The light emitting diode circuit 132 includes a light emitting diode driving circuit 118, a signal conversion unit 108, a data identifier 110, a logic controller 112, a shift register 114, an output register 116, a register 120, a comparator 122, a voltage regulator 106 and an oscillator 130. The signal conversion unit 108 includes a constant voltage generator 10802, a voltage subtractor 10804 (as shown in FIG. 4) and a signal filter 10806. The components mentioned above are electrically connected to each other. The voltage subtractor 10804 of FIG. 4 can be replaced by a signal amplifier 10808 of FIG. 5 as well.

Moreover, the signal conversion unit 108 is configured to receive a first signal 302 through the positive contact 102. The signal conversion unit 108 is configured to convert the first signal 302 into a second signal 304 and is configured to send the second signal 304 to the data identifier 110. The data identifier 110 is configured to identify the second signal 304 to obtain a third signal 306. The third signal 306 includes a data 308 and a lighting data 310. The data identifier 110 is configured to send the third signal 306 to the logic controller 112. The logic controller 112 is configured to send the data 308 to the register 120. The comparator 122 is configured to compare the data 308 with the local data 312 stored in the memory 124.

Moreover, if the data 308 is the same with the local data 312, the comparator 122 is configured to inform the logic controller 112 that the data 308 is the same with the local data 312, so that the logic controller 112 is configured to send the lighting data 310 to the light emitting diode driving circuit 118 through the shift register 114 and the output register 116. The light emitting diode driving circuit 118 is configured to drive the at least one light emitting diode 20 to light based on the lighting data 310.

The advantage of the present disclosure is to burn the local stored signal 208 into the light emitting diode driving apparatus 10 which had been manufactured to store or change the local data 312, and the light emitting diode driving apparatus 10 can be burned repeatedly. Moreover, compared to the burning data which is sent through the power carriers when burning, the present disclosure can avoid incorrectly determining the conventional carrier signal as the burning signal.

Although the present disclosure has been described with reference to the preferred embodiment thereof, it will be understood that the disclosure is not limited to the details thereof. Various substitutions and modifications have been suggested in the foregoing description, and others will occur to those of ordinary skill in the art. Therefore, all such substitutions and modifications are intended to be embraced within the scope of the disclosure as defined in the appended claims.

What is claimed is:

1. A light emitting diode system comprising:

at least one light emitting diode; and a light emitting diode driving apparatus electrically connected to the at least one light emitting diode, wherein the light emitting diode driving apparatus comprises:

a burning signal detector;

a burning controller electrically connected to the burning signal detector;

a memory electrically connected to the burning controller; and a light emitting diode circuit electrically connected to the at least one light emitting diode and the memory, wherein the burning signal detector comprises:

an optical element;

a signal trimmer electrically connected to the optical element; and a signal detector electrically connected to the signal trimmer and the burning controller, wherein the burning signal detector is configured to wirelessly receive a wireless signal; after the burning signal detector receives the wireless signal, the burning signal detector is configured to convert the wireless signal into a local stored signal; after the burning signal detector converts the wireless signal into the local stored signal, the burning signal detector is configured to transmit the local stored signal to the burning controller; the burning controller is configured to receive the local stored signal; after the burning controller receives the local stored signal, the burning controller is configured to burn the local stored signal into the memory, so that the memory is configured to store a local data;

wherein the optical element is configured to wirelessly receive a strong enough light energy of the wireless signal, and sense and convert the wireless signal into a sensing signal, and directly transmit the sensing signal to the signal trimmer without an amplifying process; the signal trimmer is configured to filter or shape the sensing signal to obtain a trimmed signal, and transmit the trimmed signal to the signal detector; the signal detector is configured to detect the trimmed signal to obtain the local stored signal.

2. The light emitting diode system of claim 1, wherein the signal trimmer is a filter.

3. The light emitting diode system of claim 2, wherein the burning signal detector further comprises:

an impedance load electrically connected to the optical element and the signal trimmer.

4. The light emitting diode system of claim 3, wherein the impedance load is a metal oxide semiconductor field effect transistor.

5. The light emitting diode system of claim 4, wherein the burning signal detector further comprises:

a voltage source electrically connected to the optical element and the impedance load.

6. The light emitting diode system of claim 5, wherein the optical element is a pn junction, a photo transistor or a photo diode.

7. The light emitting diode system of claim 6, further comprising:

a burner wirelessly connected to the burning signal detector, wherein the burner is configured to wirelessly transmit the wireless signal to the optical element of the burning signal detector.

8. The light emitting diode system of claim 7, further comprising:

a positive contact, wherein the light emitting diode circuit comprises:

a light emitting diode driving circuit electrically connected to the at least one light emitting diode;

a signal conversion unit electrically connected to the positive contact;

a data identifier electrically connected to the signal conversion unit;

a logic controller electrically connected to the data identifier and the memory;

a shift register electrically connected to the logic controller;

an output register electrically connected to the shift register and the light emitting diode driving circuit;

a register electrically connected to the data identifier and the logic controller; and a comparator electrically connected to the logic controller, the register and the memory.

9. The light emitting diode system of claim 8, further comprising:

a negative contact, wherein the light emitting diode circuit further comprises:

a voltage regulator electrically connected to the positive contact, the negative contact and the signal conversion unit; and an oscillator electrically connected to the positive contact, the voltage regulator, the signal conversion unit, the data identifier, the logic controller, the shift register and the output register.

10. The light emitting diode system of claim 9, wherein the signal conversion unit comprises:

a constant voltage generator electrically connected to the positive contact;

a voltage subtractor or a signal amplifier, electrically connected to the constant voltage generator; and a signal filter electrically connected to the voltage subtractor or the signal amplifier, and electrically connected to the data identifier.

* * * * *